United States Patent [19]

Bright et al.

[11] 4,374,607

[45] Feb. 22, 1983

[54] ELECTRICAL PIN AND SOCKET CONNECTOR

[75] Inventors: Edward J. Bright, Elizabethtown; Hitesh Cherry, Harrisburg; Robert E. Dehoff, Mt. Joy; James L. Fedder, Middletown; Tom R. Williams, Elizabethtown, all of Pa.

[73] Assignee: AMP Incorporated, Harrisburg, Pa.

[21] Appl. No.: 258,820

[22] Filed: Apr. 29, 1981

[51] Int. Cl.[3] ..... H01R 11/22

[52] U.S. Cl. ..... 339/253 R; 339/251

[58] Field of Search ..... 339/91 R, 217 R, 217 S, 339/251, 252 R, 252 P, 252 S, 253 S, 253 R, 255 RT, 256 RT, 267, 273 R, 273 F; 403/289, 290

[56] References Cited

U.S. PATENT DOCUMENTS 3,122,408 2/1964 Laszczewski ..... 339/273 F

FOREIGN PATENT DOCUMENTS 718096 10/1931 France ..... 339/252 P

*Primary Examiner*—Eugene F. Desmond
*Assistant Examiner*—David Pirlot
*Attorney, Agent, or Firm*—Allan B. Osborne

[57] ABSTRACT

The invention disclosed herein is a pin and socket connector having a low insertion force and a high resistance to tensile forces. More particularly, the pin, which is composed of spring beam members, and the socket, have complementary locking teeth and grooves and also cooperating means for releasing the spring beam members into locking engagement with the socket.

4 Claims, 9 Drawing Figures

ELECTRICAL PIN AND SOCKET CONNECTOR

BACKGROUND OF THE INVENTION

1. The Field of the Invention

The invention disclosed herein relates to electrical pin and socket type connectors for joining high voltage-carrying cable. More specifically, the present invention relates to pin and socket connectors that have locking means to prevent unmating.

2. The Prior Art

Prior art and contemporary pin and socket connectors are exemplified by the COPALUM Welding Cable Disconnects sold by AMP Incorporated of Harrisburg, Pennsylvania. These type connectors have a pin split into two spring beams so that upon being inserted into the socket, the beams are compressed to effect a good electrical contact. A lug in the socket engages a groove on the pin to releasably lock the two together.

SUMMARY OF THE INVENTION

The preferred embodiment constructed in accordance with the present invention includes a pin which is composed of four, parallel spring beams and held in a closed condition by a retaining ring. Further, a series of locking teeth are provided on the pin with the straight walls thereon facing rearwardly. The socket includes a receptacle with a knob receiving cavity in its rearward wall with the wall surrounding and defining the cavity opening providing the means to dislodge the retaining ring back into an undercut on the knob. The circumferential wall of the receptacle is provided with a complementary series of tooth receiving grooves which receive the locking teeth on the pin when the retaining ring is dislodged, permitting the spring beams expand outwardly.

The second embodiment differs from the first in that the knob and cavity opening wall cooperate to pull the retaining ring forwardly off the knob.

The third embodiment differs from the first two in that the retaining ring is placed around the pin behind the locking teeth and is dislodged by the receptacle wall as the pin is inserted thereinto.

DESCRIPTION OF THE INVENTION

Figure 1:
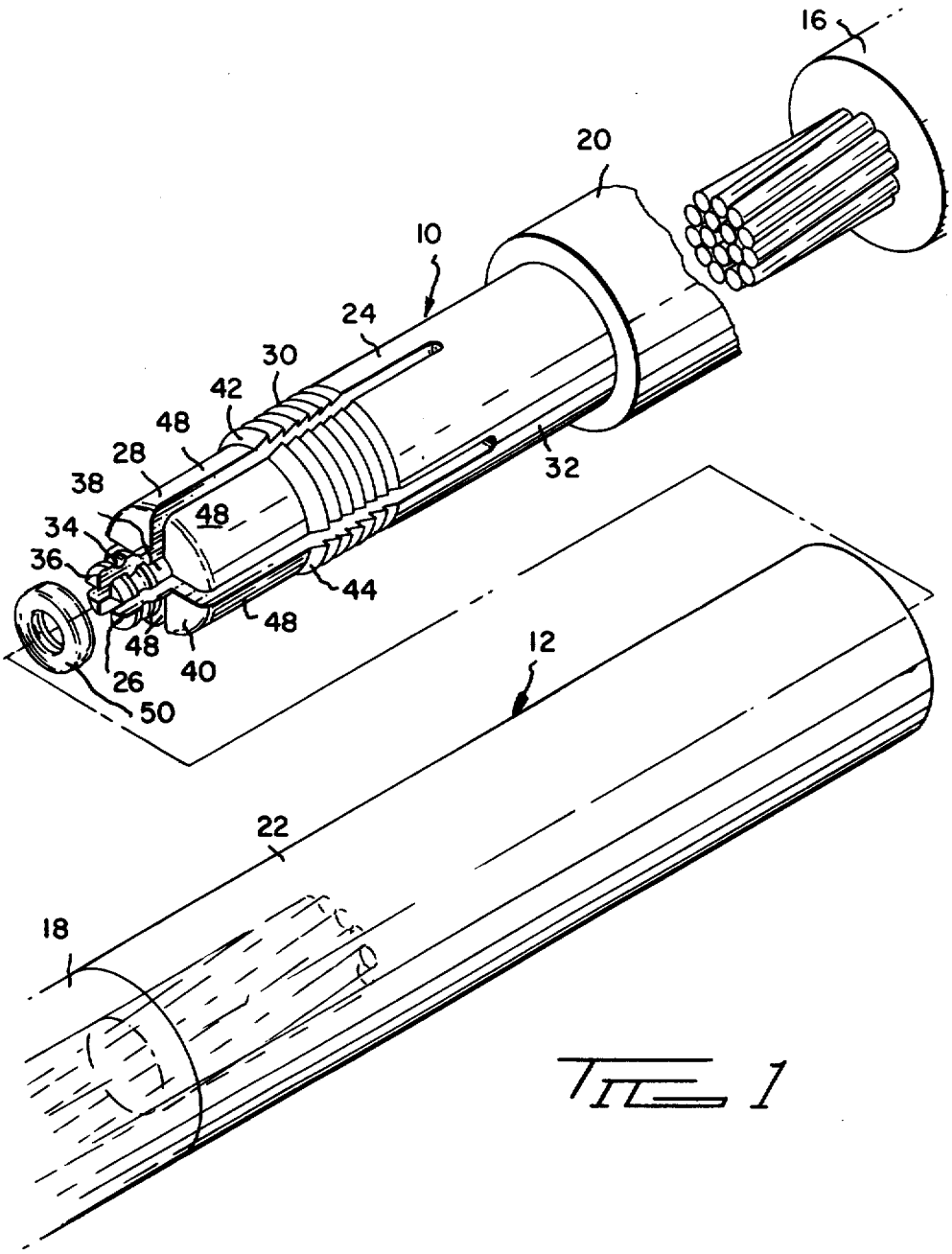
FIG. 1 is a perspective view of the preferred embodiment.
Figure 4:
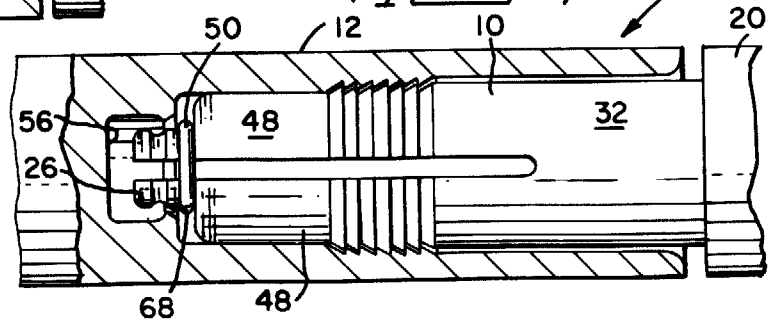

With reference to FIG. 1, pin 10 and socket 12 telescopingly mate to form electrical connector 14 shown in FIG. 4. Cable ends 16 and 18 are secured in the hollow, cable-receiving ends 20 and 22 of the pin and socket, respectively. The cables may be secured by conventional means such as crimping or soldering.

Pin 10 is preferably made from a solid rod (not shown) of conductive material such as tin plated copper alloy. The forward end 24 of the pin comprises the socket insertion means and has four distinct sections.

From front to back; i.e., left to right, these sections are: knob 26, contact 28, locking 30, and anti-strain section 32.

Knob 26 includes a first, circumferential groove 34 adjacent the free end 36. The knob is connected to the contact section by a shaft which defines a second, deeper circumferential groove 38 next to the forward face 40 of contact section 28.

Contact section 28 is smooth surfaced and extends to the first locking tooth 42 on locking section 30.

The locking section includes a number of locking teeth 42, each of which consists of a forwardly facing, sloping or beveled surface 44 and a straight surface 46 (FIG. 2) which extends normal to the longitudinal axis of the pin.

The anti-strain section 32 has a smooth surface. It's diameter is the same as the diameter of locking section 30 while the diameter of contact section 28 is smaller.

Figure 2:
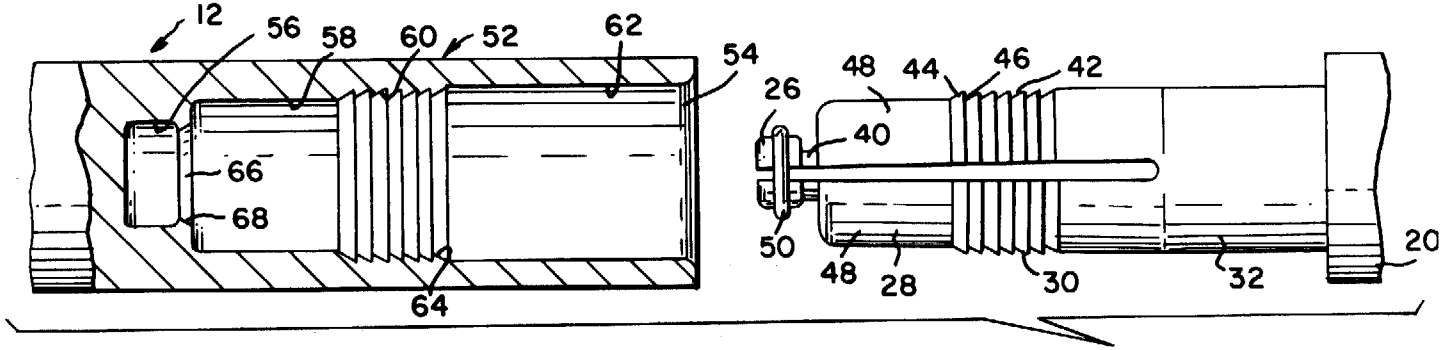
FIGS. 2, 3, and 4 are views of the preferred embodiment with the socket in section and showing the mating of the pin therewith.

The greater length of the forward end is quadfurcated to form four spring beam members 48. The quadfurcating occurs after the four sections are milled or otherwise formed. After being formed, the beam members are sprung or deformed outwardly. Thereafter, they are brought inwardly towards each other and held by a solid, retaining ring 50 positioned in groove 34 on knob 26. FIG. 2 shows this clearly.

FIG. 1 shows only the outer surface of socket. Therefore, reference to FIG. 2 is required for the following description of that member.

As with pin 10, an aperture (not shown) is provided in rearward end 22 to receive the bared end (not shown) of cable 18. The forward end 52 is bored out to provide a receptacle for the pin. Generally speaking, receptacle 54 has basically the same profile as forward end 24 on pin 10 so as to conformably receive it. Four sections of the receptacle are: knob receiving cavity 56, contact receiving section 58, locking teeth receiving section 60 and anti-strain receiving section 62. Three sections 56, 58, and 62 are smooth walled sections and lack any other structural features. The wall of the locking teeth receiving section contain circumferential grooves 64 which receive teeth 42. The diameters of sections 58 and 60 are such that contact section 28 and locking section 30 completely fill those sections upon the pin and socket being completely mated. The diameter of anti-stress receiving section 62 is only slightly larger than anti-stress section 32 under the mated condition. FIG. 4 shows the fully mated relationships.

A fifth section of receptacle 54 is passage 66 located between knob-receiving cavity 56 and contact receiving section 58. The wall 68 defining the passage is tapered inwardly towards the knob-receiving cavity.

Figure 3:
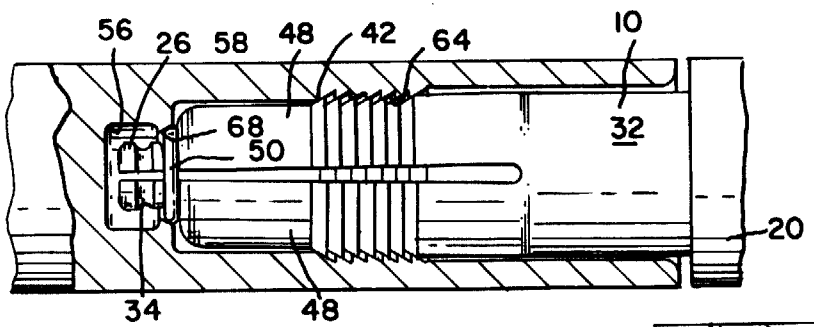

FIGS. 3 and 4 illustrate the mating and locking of pin 10 and socket 12 to form connector 14. The insertion means of pin 10 is inserted into receptacle 54. As knob 26 enters cavity 56, the tapered passage wall 68 engages and dislodges retaining ring 50 from groove 34. With continued forward motion of the pin the retaining ring rides over the nose by compressing the beams inwardly and then drops into deeper groove 38; i.e., around the shaft. At this point, the leading tooth 42 on the locking section abuts against the smaller diameter contact receiving section 58, halting the forward travel of the pin. Now the four spring beam members 48 are free to and do move outwardly toward their sprung or deformed position. This expansion force moves the pin backwards and teeth 42 slide fully into grooves 64 locking the pin and socket together against rearward movement. The surfaces of the beam members comprising contact section 28 press against the wall of contact receiving section 58 to establish good electrical contact. The compressive forces are exerted against the cavity walls continuously as the beam members have not returned to their full sprung position. FIG. 4 shows the fully mated connector.

Movement by cables 16 and 18 in non-longitudinal directions will be taken up between anti-stress section 32 on the pin and the wall defining section 62 in receptacle 54 in the socket and not transferred to the locking and contact sections.

Figure 5:
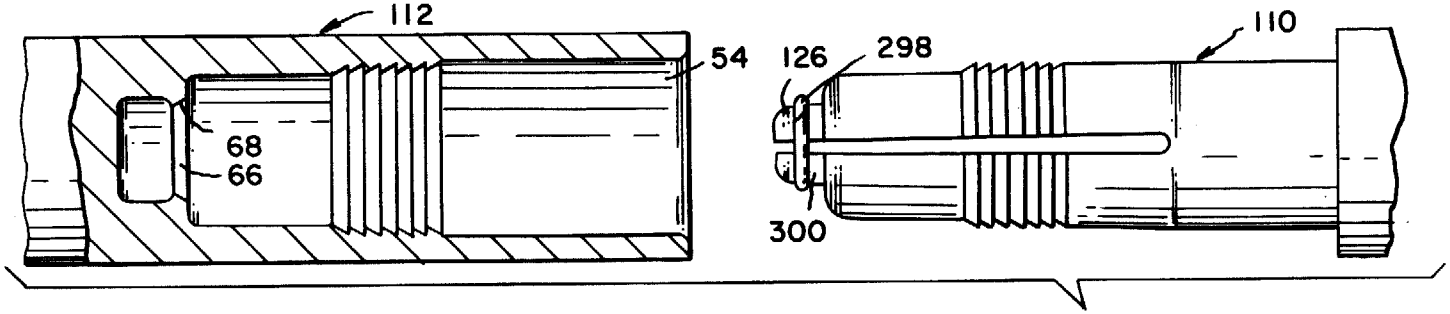
FIGS. 5, 6, and 7 are views of an alternative embodiment with the socket in section and showing the mating of the pin therewith.
Figure 6:
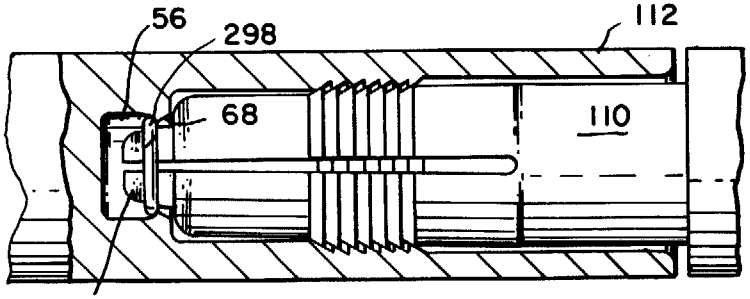
Figure 7:
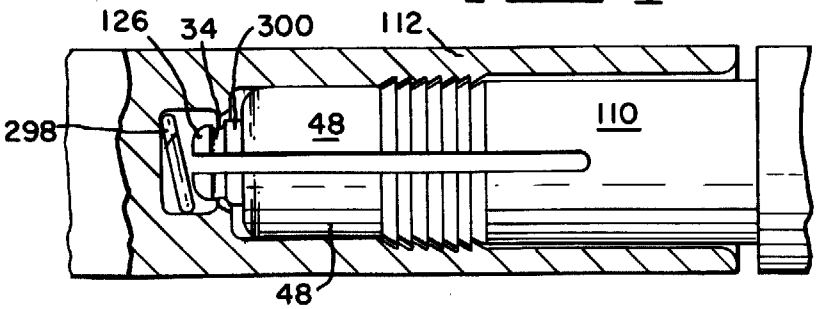

FIG. 5 illustrates a second embodiment of the present invention and FIGS. 6 and 7 illustrate the manner of mating. Pin 110 differs from pin 10 only in the shape of the knob. Knob 126 on pin 110 does not have the second, deeper groove 38 found on knob 26 on pin 10. It does have the first groove 34 (FIG. 7) which receives a split retaining ring 298 but the diameter of knob 126 immediately behind the first groove is greater so as to provide a shoulder 300 which functions as a stop means for the retaining ring.

Socket 112 is identical to socket 12. The manner of mating pin 110 and socket 112 differs slightly relative to the mating of pin 10 and socket 12. With reference to FIG. 6, the insertion means are inserted into receptacle 54. As knob 126 enters cavity 56, tapered wall 68 defining passage 66 compresses the split retaining ring to a reduced diameter and thus enabling it to pass into cavity 56 as shown in FIG. 6. The ring returns to its larger, original diameter which exceeds the diameter of the narrowest opening to the passage. Upon pulling back on pin 110, the ring is stripped off knob 126, releasing spring beam members 48. Teeth 42 enter grooves 60 to lock the pin in socket 112 against withdrawal.

Figure 8:
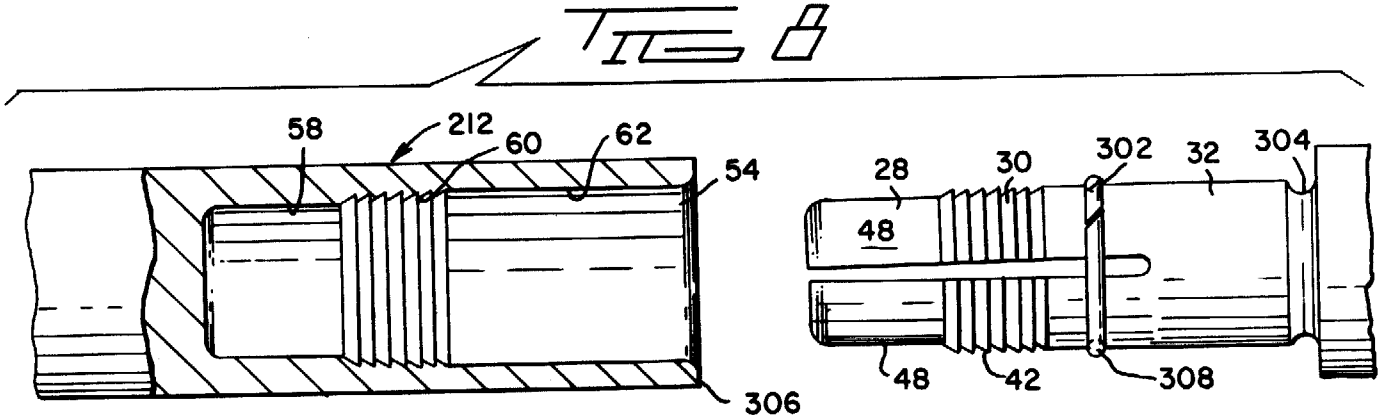
FIGS. 8 and 9 are views of yet another embodiment with the socket in section and showing the mating of the pin therewith.
Figure 9:
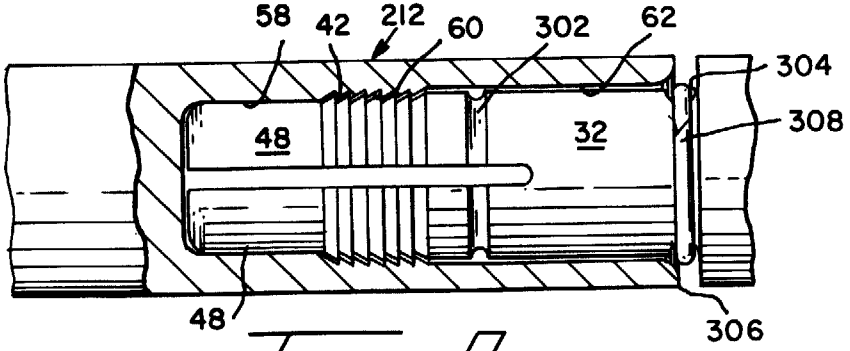

FIG. 8 illustrates a third embodiment of the present invention and FIG. 9 illustrates the manner of mating. In this embodiment, pin 210 includes contact section 28, locking section 30, and anti-strain section 32. These sections are identical to those sectons on pin 10. There is no knob but pin 210 does have a shallow groove 302 at the front of the anti-stress section and a deep groove 304 at the rear of that section. Split retaining ring 308 is initially mounted on the pin in groove 302 to hold the four spring beam members 48 in a compressed position.

Socket 212 differs from the previously disclosed sockets only in not having a knob receiving cavity and the passage leading thereto. However, the dimensions of the receptacle in sockets 12 and 112 are such that they can receive pin 210 without alteration. The advantage of socket 212 is that it can be manufactured more economically.

To mate the two, pin 210 is inserted into receptacle 54. As the leading edge 306 of the wall defining the receptacle strikes the retaining ring, the ring becomes dislodged from groove 302 and pushed back as the insertion means travels further into the receptacle. At the time the ring is being dislodged, contact section 28 is starting into section 58. With the pin fully inserted, ring 50 is in deeper groove 304 and the locking teeth 42 are in locking grooves 60.

The present invention may be subject to many modifications and changes without departing from the spirit or essential characteristics thereof. The present embodiment is therefore intended in all respects as being illustrative and not restrictive of the scope of the invention.

What is claimed is:

1. A pin and socket connector of the type formed by the pin being telescopingly received in the socket, said connector comprising:

a. an elongated pin of conductive material having cable receiving means at one end and cylindrical, socket insertion means at the opposite end, said insertion means being slotted to define a plurality of spring beam members and further having a plurality of outwardly projecting teeth encircling the circumference of the insertion means at a location rearwardly of its free end;

b. removable means positioned on the insertion means adapted to removably hold the spring beam members together in a compressed position; and c. an elongated socket having cable receiving means at one end and a receptacle at the opposite end adapted to receive the insertion means of the pin with the receptacle wall containing a plurality of circumferential, tooth-receiving grooves and the socket further having means to remove the removable means upon the receptacle receiving the insertion means thereby permitting the spring beam members to expand, forcing the teeth into the teeth-receiving grooves to thereby lock the pin in the socket.

2. The pin and socket connector of claim 1 wherein the pin includes a knob extending forwardly from and connected to the free end of the insertion means by a shaft of lesser diameter with a groove encircling the knob, and said removable means includes a ring removably positioned in the groove and further, said means to remove the removable means on the socket includes a knob-receiving cavity in the rear wall of the receptacle and connected thereto by a passage of a predetermined diameter so that as the knob is inserted into the cavity the wall defining the passage dislodges the ring from the groove whereupon further insertion, the ring is moved back around the shaft thereby permitting the spring beam members to expand.

3. The pin and socket connector of claim 1 wherein the pin includes a cylindrical knob of smaller diameter than and extending forwardly from the free end of the insertion means, a groove encircling the circumference of the knob and further said removable means includes a split retaining ring positioned in the groove and further the means to remove the removable means on the socket includes a knob-receiving cavity in the rear wall of the receptacle with a passage defined by a tapered wall between the cavity and receptacle with the convergences of the taper being towards the cavity so that upon the knob being inserted into the cavity and then slightly withdrawn, the wall catches and dislodges and ring from the knob.

4. The pin and socket connector of claim 1 wherein a first groove encircles the circumference of the insertion means at a location back of the plurality of teeth and the removable means includes a split retaining ring positioned in the first groove so that as the insertion means are inserted into the receptacle the wall defining the opening thereto catches and dislodges the ring from the first groove and as the insertion means further enter the receptacle, the ring is pushed back beyond the spring beam members thereby allowing said members to expand, forcing the teeth into the teeth-receiving grooves.

* * * * *